US012649555B2

(12) United States Patent
Pallu de la Barrière et al.

(10) Patent No.: US 12,649,555 B2
(45) Date of Patent: Jun. 9, 2026

(54) LIFT-GENERATING SYSTEM AND BOAT FITTED WITH SUCH A SYSTEM

(71) Applicant: CENT RECH ARCHIT INDU NAUTIQUE, La Rochelle (FR)

(72) Inventors: Philippe Pallu de la Barrière, La Rochelle (FR); Jérôme Vedrenne, La Baule (FR)

(73) Assignee: CENT RECH ARCHIT INDU NAUTIQUE, La Rochelle (FR)

( * ) Notice: Subject to any disclaimer, the term of this patent is extended or adjusted under 35 U.S.C. 154(b) by 274 days.

(21) Appl. No.: 18/259,331

(22) PCT Filed: Feb. 15, 2022

(86) PCT No.: PCT/FR2022/050268

§ 371 (c)(1),
(2) Date: Jun. 26, 2023

(87) PCT Pub. No.: WO2022/175622

PCT Pub. Date: Aug. 25, 2022

(65) Prior Publication Data

US 2024/0051648 A1 Feb. 15, 2024

(30) Foreign Application Priority Data

Feb. 17, 2021 (FR) ..... 2101534

(51) Int. Cl.
*B63H 9/061* (2020.01)

(52) U.S. Cl.
CPC ..... *B63H 9/0635* (2020.02)

(58) Field of Classification Search
CPC ... B63H 9/00; B63H 9/02; B63H 9/04; B63H 9/06; B63H 9/061; B63H 9/0635;
(Continued)

(56) References Cited

U.S. PATENT DOCUMENTS 4,630,997 A * 12/1986 Cousteau ..... B64C 21/06 416/4
8,261,618 B2 * 9/2012 Engle ..... G01L 19/04 73/754

(Continued)

FOREIGN PATENT DOCUMENTS

AU 3526289 A 12/1989
CN 109760813 A 5/2019

(Continued)

OTHER PUBLICATIONS

International Search Report and Written Opinion dated Jun. 3, 2022 in corresponding application No. PCT/FR2022/050268; with English partial translation and partial machine translation (total 15 pages).

(Continued)

*Primary Examiner* — Daniel V Venne
(74) *Attorney, Agent, or Firm* — Seckel IP, PLLC

(57) ABSTRACT

The lift-generating system (101) includes a wing (1) having at least one suction opening (12) designed to establish a connection between the exterior of the wing and the interior (102) of the wing (1); and a suction device, a support (4) on which the wing (1) is mounted so as to be able to pivot about an axis substantially parallel to the axis (A1). The suction device includes a fan (3) located outside the wing (1) and fluidically connected to the interior (102) of the wing (1) so as to draw air through the at least one suction opening (12) of the wing, and discharge the drawn-in air through an outlet of the fan (3). The fan (3) includes an impeller (30) surrounded by a shroud (31) which defines, around the impeller, a duct that serves to guide the air discharged by the impeller, and a motor for rotating the impeller (30) about an axis substantially parallel to the axis (A1) of the wing. The shroud (31) of the fan (3) has an outlet (32) of which the axis (Continued)

(A32) is substantially orthogonal to the axis (A30) of the impeller (30) of the fan. The lift-generating system can be provided for a boat.

21 Claims, 8 Drawing Sheets

(58) Field of Classification Search
CPC ..... B63H 7/00; B63H 7/02; B63B 2035/009; Y02T 70/5236
USPC ..... 114/102.1, 39.21, 39.29, 39.3; 416/4
See application file for complete search history.

(56) References Cited

U.S. PATENT DOCUMENTS

| | | | | |
|---|---|---|---|---|
| 11,142,294 | B2 * | 10/2021 | Malpede | B63H 9/04 |
| 12,134,455 | B2 * | 11/2024 | Bermudez Miquel | B63H 9/04 |
| 2020/0115019 | A1 | 4/2020 | Malpede et al. | |
| 2022/0177097 | A1 | 6/2022 | Bermudez Miquel et al. | |

FOREIGN PATENT DOCUMENTS

| | | | |
|---|---|---|---|
| EP | 0055638 | A1 | 7/1982 |
| FR | 2275360 | A1 | 1/1976 |
| FR | 2503286 | A2 | 10/1982 |
| JP | S57-147994 | A | 9/1982 |
| JP | 2005-225271 | A | 8/2005 |
| WO | 2014131873 | A2 | 9/2014 |
| WO | 2018211260 | A1 | 11/2018 |
| WO | 2020193835 | A1 | 10/2020 |

OTHER PUBLICATIONS

JP Office Action dated Jan. 28, 2026 in counterpart application JP 2023-540670; with English machine translation (total 18 pages) (note: US20200115019, D4 cited in the JP Office Action, is not listed in this IDS since it is already of record in this application).
CN Office Action and Search Report dated Mar. 20, 2026 in counterpart application CN 2022800152416; with English machine translation (total 17 pages) (note: CN10976813, U.S. Pat. No. 4630997, and WO2020193835 cited in the CN Office Action are not listed in this IDS since they are already of record in this application).

* cited by examiner

LIFT-GENERATING SYSTEM AND BOAT FITTED WITH SUCH A SYSTEM

FIELD OF THE INVENTION

The present invention relates in general to systems intended to be placed in moving air in order to produce lift, or lift generators. In the case of wind-propelled vehicles, these systems are also known as wind motors.

PRIOR ART

Wind motors which comprise an elongate hollow body, suction zones formed along the peripheral wall of the hollow body, and suction means housed inside the hollow body, are known from the prior art, and notably from document FR2503286A2. The suction at the peripheral wall of the motor makes it possible to limit flow separation of the flow of the air from the wall of the motor.

Document FR2503286A2 thus describes a sail of which the body houses several fans.

However, it is desirable to be able to improve the performance of these motors.

SUMMARY OF THE INVENTION

To this end, one subject of the invention is a lift-generating system intended to be placed in moving air so as to produce a lift force, the lift-generating system comprising:

- a hollow body, referred to as a sail, that is elongate along an axis, the peripheral wall of the sail having at least one opening, referred to as suction opening, designed to cause the outside of the sail to communicate with the inside of the sail; and
- a suction device allowing air to be drawn in through said at least one suction opening;
- characterized in that the lift-generating system comprises a support which supports the sail and with respect to which the sail is mounted with the ability to pivot about an axis substantially parallel to the axis of the sail,
- and said suction device comprises a fan situated outside the sail and in communication with the inside of the sail so as to draw air through said at least one suction opening in the sail and discharge the drawn-in air via an outlet of the fan,
- the fan comprising an impeller wheel, surrounded by a housing which defines, around the impeller wheel, a duct able to guide the air discharged by the impeller wheel, and a motor to drive the rotation of the impeller wheel about an axis substantially parallel to the axis of the sail, the housing of the fan having an outlet of axis substantially orthogonal to the axis of the impeller wheel of the fan.

Positioning the suction device outside of the sail (also referred to as hollow body or airfoil profile) means that the footprint of the suction device is not constrained by the dimensions of the inside of the sail as far as the choice of suction device is concerned, unlike in the solutions of the prior art in which the suction device is housed inside the sail. Thus, it is possible to select a fan of maximized efficiency by selecting a diameter/rotational speed pairing that is particularly effective and is able to provide the suction flow rate for the entire sail.

The main function of the fan is to ventilate the sail. As a preference, the fan is situated as close as possible to the lower end of the sail.

The system according to the invention thus makes it possible to use a fan of the centrifugal or mixed-flow type in order to obtain the desired propulsion performance from the lift-generating system without the need to increase the cross section of the sail.

In order to obtain the operating point of the lift-generating system with the same efficiency and suction means located inside the sail, it would be necessary to split the suction means into several modules distributed along the sail, and this would increase the complexity of the system and the manufacturing and maintenance costs.

The centrifugal fan can be placed at the foot of the sail.

When the system according to the invention is mounted on the deck of a boat, the casing of the fan is fixed relative to the deck of the ship. In this way, it is possible for the air to be discharged parallel to the longitudinal axis of the ship by directing the corresponding air outlet of the fan along this axis, toward the stern of the boat. The air discharged thus contributes to the propulsive force through a jet effect.

In the solutions known from the prior art in which the suction means are placed inside the sail, the direction in which the air is discharged is dependent on the orientation of the motor, so that the air discharged does not necessarily contribute to the force propelling the boat along the axis of the boat.

Mounting the sail such that it can pivot relative to the support which is intended to be fixed on the deck of the boat allows the sail to turn, preferably about its vertical axis, so that it orients itself relative to the direction of the apparent wind.

Advantageously, an orifice located in the lower part of the sail allows direct communication between the fan and the inside of the sail. This arrangement makes it possible to reduce the pressure drops that would occur in intermediate ducting. According to one particular embodiment, provision may be made for a duct of a length less than the diameter of the fan, for example of a length of a few tens of centimeters in the case of a fan diameter of the order of two meters, to be positioned between the sail and the fan.

The fan represents a not-inconsiderable mass of the system. The fact that this fan is placed at the base of the sail offers numerous advantages.

Inbuilt masses are subjected to the accelerations of the ship. The fact that the fan is placed outside of and at the foot of the sail means that the forces exerted on the sail are greatly reduced. Specifically, there are two types of force that combine here with the accelerations of the ship. On the one hand, inertial forces which are directly linked to the mass of the centrifugal fan and, on the other hand, gyroscopic forces originating from the rotation of the fan. Thus, the structure of the system can be lightened and manufacturing costs are reduced.

Placing the fan at the foot of the sail makes it easier to access, so that maintenance operations become easier.

According to one particular aspect, when mounted on the deck of the boat, the suction device is situated below the sail, between the deck of the boat and the sail.

It should be noted that, in document FR2503286A2, each fan is situated not outside the sail but indeed inside the sail.

It will be appreciated that, according to the invention, the pivoting of the sail about its axis does not cause the fan to pivot or change orientation.

The generating system may also comprise one or more of the following features considered in any technically permissible combination.

According to one embodiment, the system comprises a hollow connecting element which extends at least partly between the lower end of the sail and the fan to allow fluidic communication between the sail and the fan.

According to one embodiment, the connecting element comprises a form-matching wall in which an opening that communicates with the fan is formed.

According to one embodiment, the form-matching wall is equipped with an annular element which extends around the opening of the form-matching wall and on the side of the inside of the sail, the cross section of said annular element having a curved, for example convex, profile so as to limit the pressure drops experienced by the air flow between the sail and the fan.

According to one embodiment, the fan is contained within an imaginary housing that surrounds the support. In other words, the fan is contained within the overall footprint of the support.

According to one embodiment, the fan is a centrifugal fan.

According to one embodiment, the fan is a mixed-flow fan.

According to one embodiment, the sail is equipped with a device that generates vertical lift, which device is mounted close to one and/or the other of the ends of the sail.

According to one embodiment, the device that generates vertical lift comprises at least a part which is mounted with the ability to move about an axis substantially orthogonal to the axis of the sail.

According to one embodiment, the device that generates vertical lift comprises a suction system allowing air from outside to be drawn into the inside of the sail.

According to one embodiment, the peripheral wall of the sail is equipped with a flap that is able to move relative to the peripheral wall to make it possible to separate the suction-face air flow from the pressure-face air flow.

According to one embodiment, the length of the flap is equal to the length of the sail.

According to one embodiment, the peripheral wall of the sail has two suction openings and a shutoff system, such as a flap, so as to allow one of the suction openings to be selectively shut off and the other suction opening to be uncovered.

According to one embodiment, the housing of the fan is extended by a variable-section discharge duct, the cross section preferably decreasing toward the outlet end of the discharge duct.

According to one embodiment, the system comprises a tilting system to allow the sail, and possibly its support, to be tilted about an axis substantially orthogonal to the axis of the sail, preferably a substantially horizontal axis.

The invention also relates to a boat comprising at least one lift-generating system according to any one of the embodiments set out hereinabove, wherein the fan is situated between the sail and the deck of the boat, and, the sail being mounted with the ability to pivot relative to the deck of the boat, about an axis substantially parallel to the axis of the sail.

According to one particular aspect, the support is arranged in such a way that, when the sail is standing vertically (which is to say perpendicular to the deck of the boat) and pivots about an axis substantially parallel to the axis of the sail (which is to say, during operation of the sail—with the sail vertical—and outside of any mobility whereby the support tilts about an axis orthogonal to the axis of the sail), the support remains fixed with respect to the deck of the boat.

According to one particular aspect, the fan is arranged in such a way that when the sail is standing vertically and pivots about an axis substantially parallel to the axis of the sail, the housing of the fan remains fixed relative to the deck of the boat.

According to one embodiment, the axis of the outlet of the casing of the fan is directed toward the stern of the boat, preferably substantially parallel to the longitudinal axis of the boat.

BRIEF DESCRIPTION OF THE DRAWINGS

Further features and advantages of the invention will become further apparent from the following description which is purely illustrative and nonlimiting and is to be read in connection with the attached drawings, in which.

DETAILED DESCRIPTION

Figure 1:
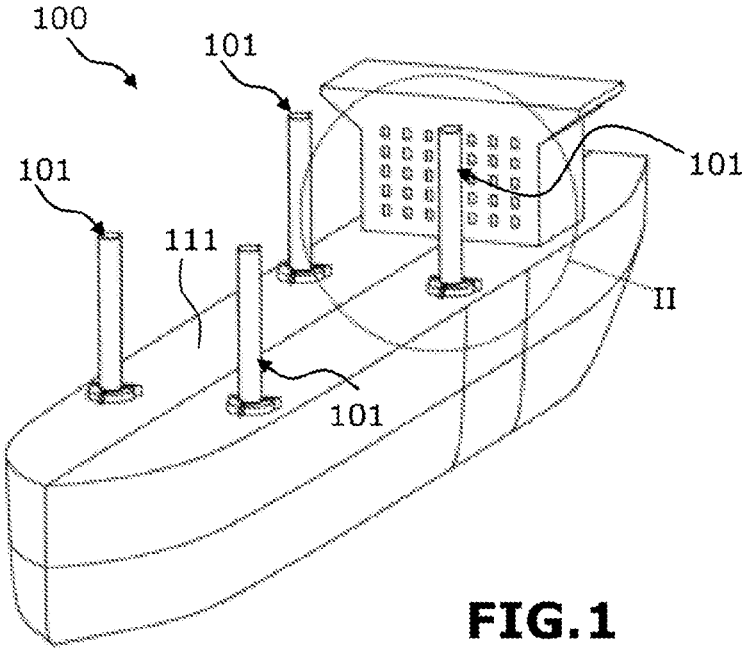
FIG. 1 is a perspective view of a boat equipped with several lift-generating systems according to one embodiment of the invention.

The concept of the invention is described more fully hereinafter with reference to the attached drawings which show embodiments of the concept of the invention. In the drawings, the size and relative sizes of the elements may have been exaggerated for the sake of clarity. Similar numerals refer to similar elements throughout the drawings. However, this concept of the invention may be implemented in numerous different forms and should not be interpreted as being restricted to the embodiments set forth here. Rather, these embodiments are offered in order for this description to be complete, and communicate the scope of the concept of the invention to those skilled in the art.

Throughout the specification, reference to "an embodiment" means that a functionality, a structure or a particular feature described in connection with an embodiment is included in at least one embodiment of the present invention. Thus, where the expression "in one embodiment" appears at various points throughout the specification this does not necessarily refer to the one same embodiment. Furthermore, the functionalities, structures or particular features may be combined in any appropriate way in one or more embodiments.

Reference is made to FIG. 1 which depicts a number of lift-generating systems 101 mounted on the deck 111 of a boat 100.

The description which follows is given for one lift-generating system 101, but also applies to several lift-generating systems 101.

Figure 2:
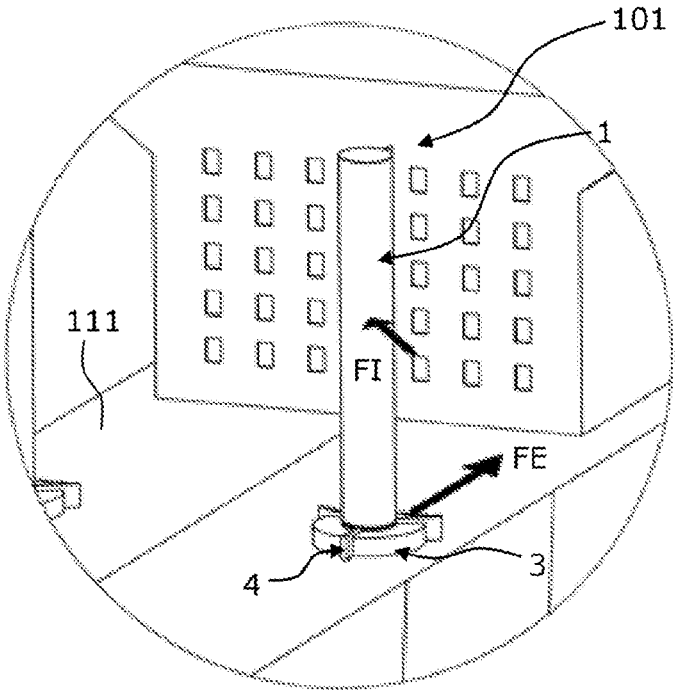
FIG. 2 is a view of detail II of FIG. 1.

As illustrated in FIG. 2, the lift-generating system 101 is placed in a moving air flow FI thus allowing a lift force to be produced. As detailed hereinafter, this lift-generating system 101 offers greater propulsion performance without the need to increase the dimensions of the sail.

Sail

The lift-generating system comprises a hollow body 1 that is elongate along an axis A1. The hollow body is commonly referred to as a sail.

The sail has an aerodynamic profile. Different shapes of profile may be employed. In the example illustrated in the figures, the profile is of ovoid shape.

The peripheral wall 10 of the sail has at least one opening 12, referred to as suction opening, able to communicate with the inside 102 of the sail 1. In the example illustrated in the figures, the peripheral wall has two suction openings 12 preferably distributed symmetrically about an axis of symmetry of the profile of the sail.

The hollow body is provided with a mobile flap 14. The flap makes it possible to modify the curvature of the profile of the sail in order to increase the lift, whether the wind comes from one side of the ship or the other. The ship is able to sail on both tacks—a port tack or a starboard tack. According to one embodiment, provision may be made for the movement of the flap to shut off one suction opening 12 and uncover the other suction opening 12.

Figure 5:
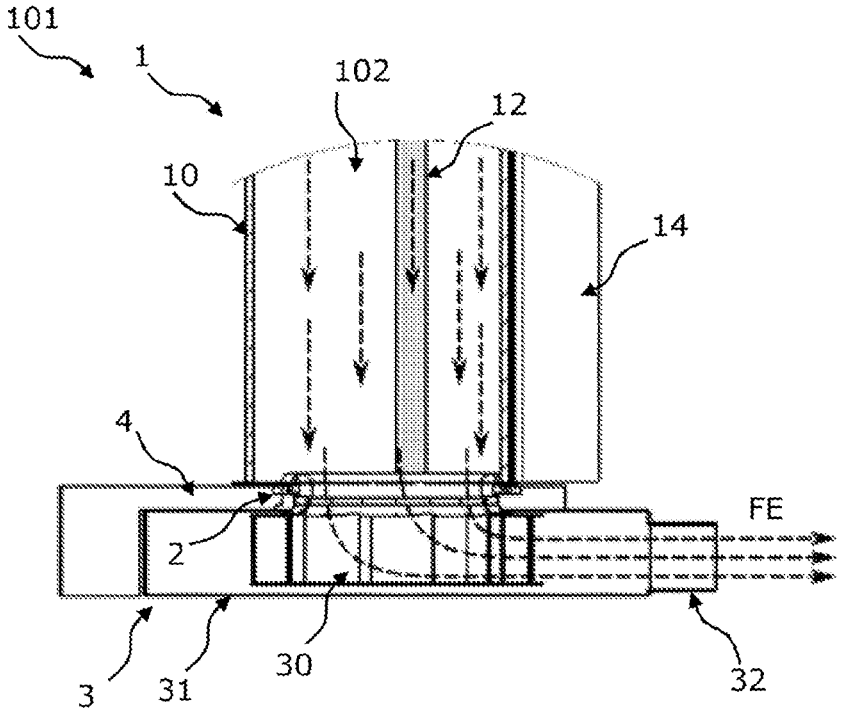
FIG. 5 is a view in section on A-A of the lower part of the lift-generating system of FIG. 4.
Figure 5A:
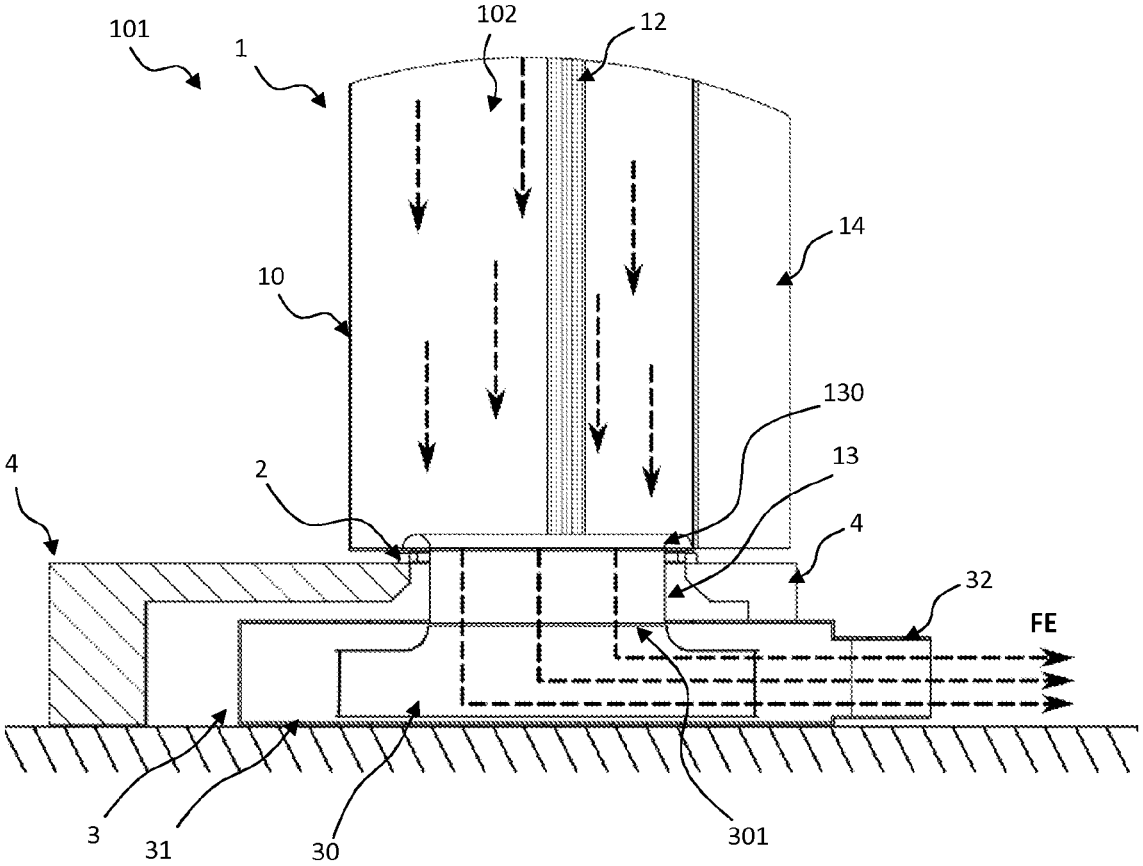
FIG. 5A is a schematic view of the lower part of the lift-generating system making it easier to see the arrangement of the elements in the lower part of the system.

According to one particular aspect and as illustrated more specifically in FIGS. 5 and 5A, the lower end of the sail 1 is equipped with a hollow connecting element 13 which extends at least in part between the lower end of the sail 1 and the fan 3 to provide fluidic communication between the sail 1 and the fan 3. The connecting element 13 comprises a form-matching wall that has an opening allowing the passage cross section for the flow of air inside the hollow body to be matched to the opening 301 of the impeller wheel 30 (or rotor) of the centrifugal fan 3 set out hereinbelow. The impeller wheel may be a bladed impeller wheel. As explained hereinafter, the fan may also be of the mixed-flow type. It should be note that when reference is made to a mixed-flow fan or a centrifugal fan this means the impeller wheel and the housing of the fan together, particularly when determining the footprint of the fan as a whole.

Suction Device

The lift-generating system comprises a suction device in communication with the inside 102 of the sail 1 to draw air in through said at least one opening 12 formed in the peripheral wall of the sail.

Provision may be made for each suction opening 12 to have an opening dimension or porosity that can vary along the sail, for example so as to vary the quantity of air drawn in according to the position along the sail. Each opening 12 may be produced in the form of a grating.

Figure 4:
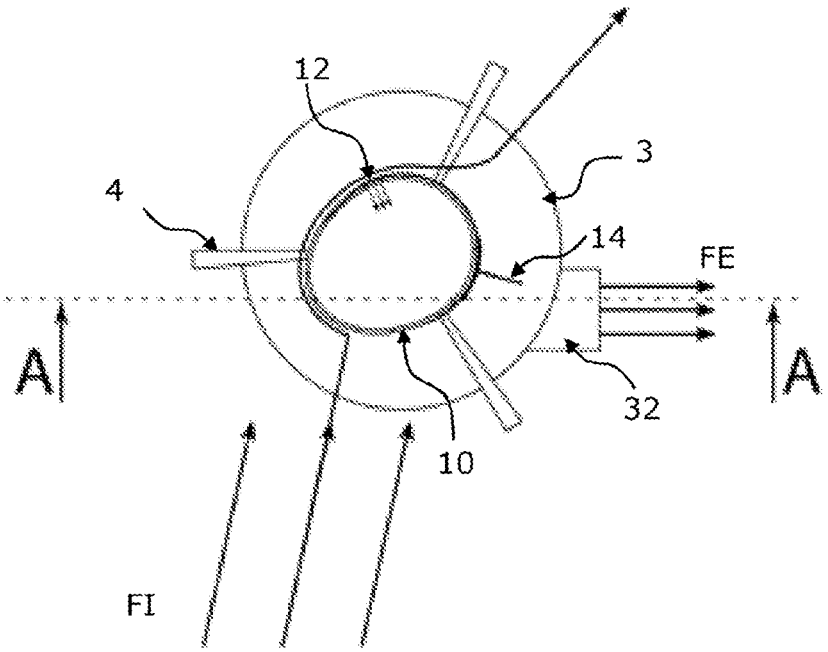
FIG. 4 is a view from above of the lift-generating system of FIG. 3.
Figure 6:
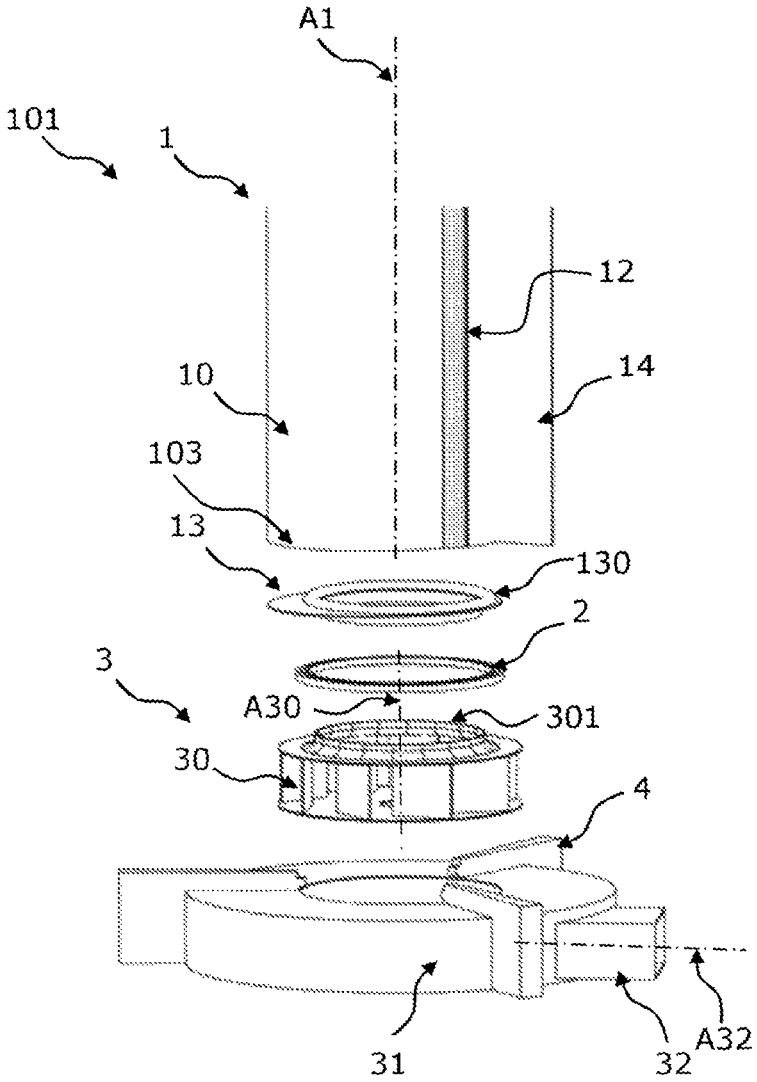
FIG. 6 is an exploded view of the lower part of the lift-generating system of FIG. 4.

As illustrated more particularly in FIGS. 4 to 6, said suction device is formed by a fan 3 which comprises an impeller wheel 30, a motor (not depicted) for driving the rotation of the impeller wheel 30, and a housing 31 (the fixed part around the impeller wheel) which extends around the impeller wheel 30. The housing 31 (also referred to as a volute housing or shroud) takes the form of a body which around the impeller wheel defines a duct, preferably of spiraloid shape, to guide the air discharged by the impeller wheel as far as an outlet 32. The geometry of the housing 31 makes it possible to improve the suction efficiency of the fan.

The fan 3 is configured to discharge the drawn-in air flow back to the free air. The fan 3 has an air inlet of axis A30 substantially orthogonal to the axis of the outlet 32 of the housing 31 of the fan 3. In other words, the direction in which air is drawn in is substantially orthogonal to the direction in which air exits the housing 31 of the fan. It will be appreciated that the air inlet axis A30 is preferably orthogonal to the axis of the outlet 32, but that there may also be a small angle of inclination of one or a few degrees, for example an angle less than 5°, of the outlet axis A32 of the outlet 32 of the housing 31 with respect to the plane orthogonal to the axis A30. Provision may be made for the outlet 32 of the housing 31 to be equipped with a discharge duct, preferably configured in such a way as to accelerate the air that is being discharged.

In the example illustrated in the figures, the fan is a centrifugal fan. According to the embodiment illustrated, the impeller wheel 30 is a bladed impeller wheel 30. The bladed impeller wheel 30 has an air inlet 301 which communicates with the inside 102 of the sail. In particular, the air inlet 301 communicates with the inside 102 of the sail via the opening of an orientation mechanism such as an orientation ring 2 (set out hereinafter) and the opening of the connecting element 13. As an alternative, the fan may be of mixed-flow type. A mixed-flow fan differs from a centrifugal fan in that, in a mixed-flow fan, the air that exits the impeller wheel enters the housing in a direction that makes an angle of 30° to 80° with respect to the air inlet axis. In a centrifugal fan, the air that exits the impeller wheel enters the housing in a direction orthogonal to the air inlet axis.

It will be noted that, in the lift-generating system 101 according to the invention, whether the fan is of the centrifugal or mixed-flow type, the air that exits the outlet 32 of the housing 31 does indeed exit orthogonally to the suction axis.

The centrifugal fan 3 is situated outside of the sail 1 and is in fluidic communication with the inside 102 of the sail 1 so as to draw air in through each opening 12 formed in the peripheral wall 10 of the sail 1 and discharge the drawn-in air via the outlet 32 of the housing 31 of the centrifugal fan 3. The air flow FE thus discharged contributes to the propulsion of the boat 100 on which the lift-generating system 101 is mounted.

The outlet 32 of the centrifugal fan 3 is directed toward the stern of the boat. Advantageously, the casing of the fan 3 is fixed relative to the support 4 and therefore relative to the deck of the boat, such that the outlet 32 is also fixed.

The opening of the form-matching wall is bordered by a peripheral element 130 which extends on the side of the inside of the sail and the cross section of which has a curved, preferably convex (bulging) shape with reference to a view from inside the hollow body. In the example illustrated in the figures, this element 130 has a toric overall shape. The form-matching wall thus provides guidance for the drawn-in air flow, thereby limiting the pressure drops experienced by the drawn-in air flow as it circulates between the inside of the hollow body and the centrifugal fan 3.

Support

Figure 3:
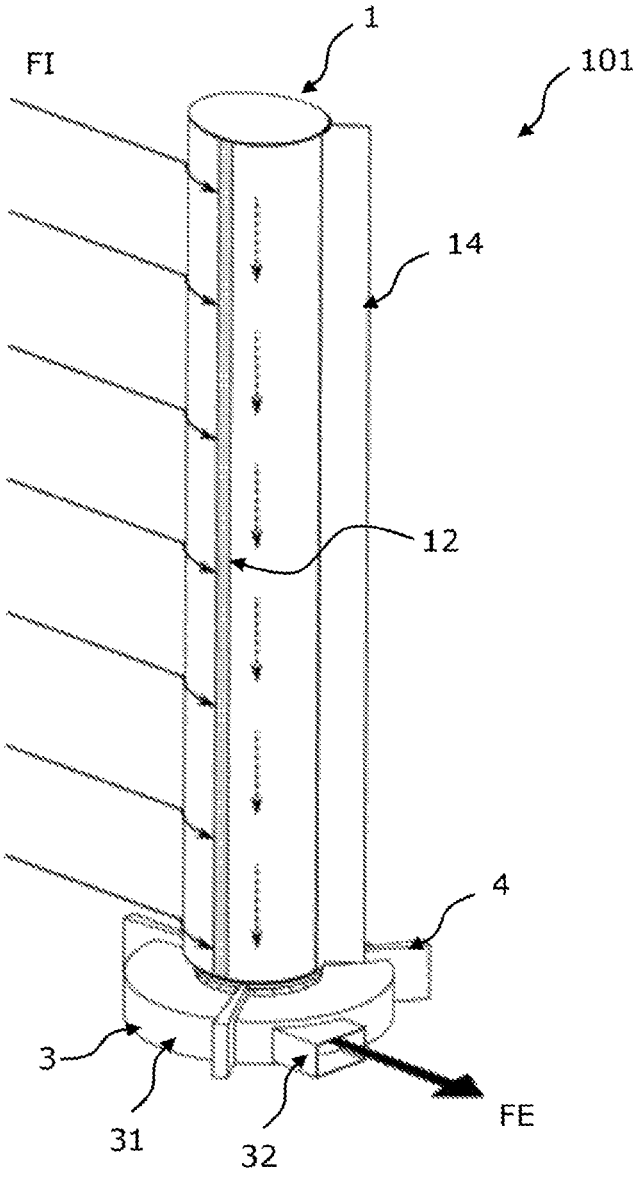
FIG. 3 is a perspective view of a lift-generating system according to one embodiment of the invention, showing an incident air flow part of which is drawn into the sail by the fan and then discharged.
Figure 3A:
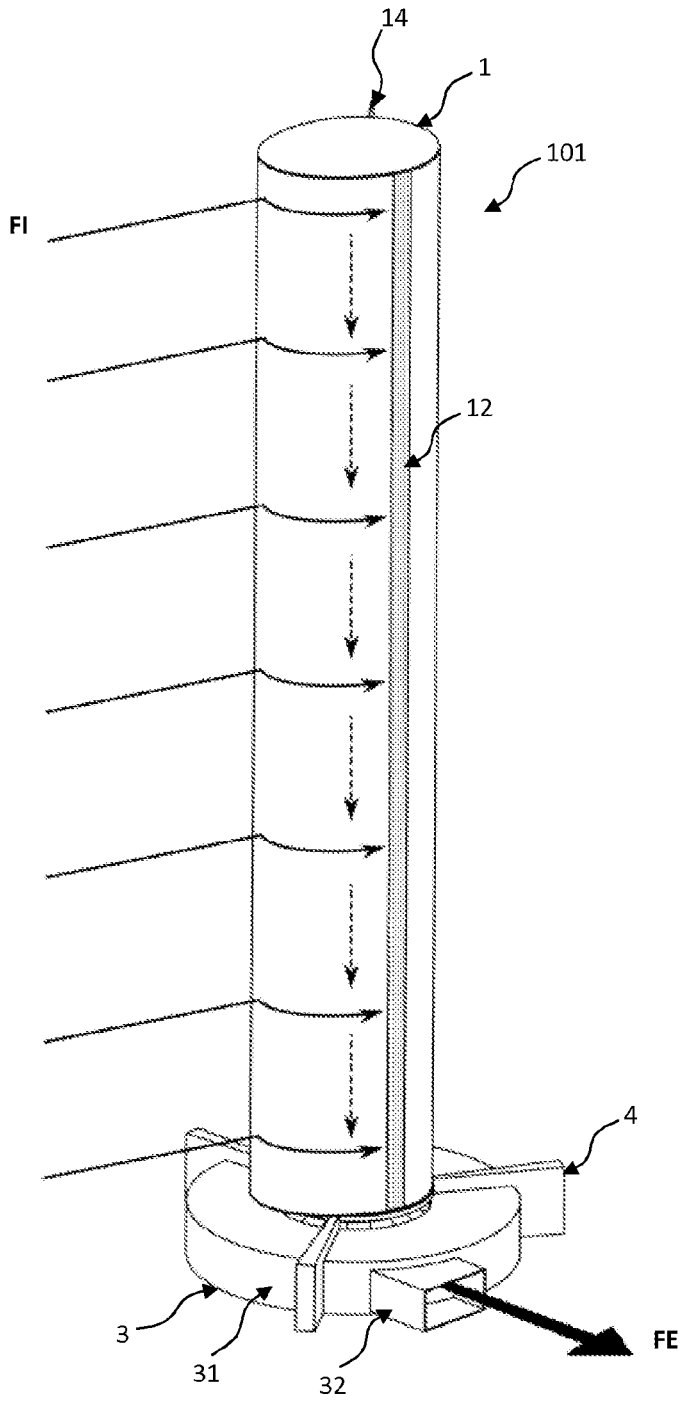
FIG. 3A is a perspective view of the lift-generating system of FIG. 3, with the sail oriented at a different angle relative to the support.

The system 101 comprises a support 4 on which the sail 1 is mounted with the ability to pivot (FIGS. 3 and 3A). As a preference, the sail is mounted so as to pivot on the support 4 about an axis substantially parallel to the longitudinal axis A1 of the sail. It will be appreciated that the axis of pivoting is preferably parallel to the longitudinal axis A1 of the sail but that the axis of pivoting may be at a small angle of one or a few degrees with respect to the axis A1, for example at an angle less than 5°. The axis A1 is preferably coincident with the axis of rotation of the sail.

Thus, when the system 101 is mounted on the deck 111 of the boat 100, the sail 1 is able to turn about its (vertical) longitudinal axis so as to orient itself relative to the direction of the apparent wind.

In the configuration of use of the system in which the sail 1 is standing upright on the deck of the ship via its support 4, the support 4 is fixed relative to the deck. In the example illustrated in the figures, the support takes the form of a collection of several feet. The support may be covered with a cowling or fairing.

The system comprises an orientation mechanism, such as an orientation ring 2, interposed between the sail 1 (preferably the lower face 103 of the sail) and the support 4, and configured to allow the sail 1 to turn, about its axis of pivoting which is substantially parallel to the axis A1, relative to the support 4. In the example illustrated in the figures, the orientation mechanism comprises a central opening which is positioned facing the air inlet opening 301 of the centrifugal fan 3, which is to say the air inlet opening of the bladed impeller wheel 30.

In the example illustrated in the figures, the centrifugal fan 3 is contained in the imaginary housing surrounding the support 4. In other words, the fan 3 is situated within the overall footprint of the support 4, making it possible to limit the footprint of the system 101 on the deck of the boat.

According to an embodiment which is not illustrated in the figures, the sail is equipped with a device for generating vertical lift, mounted near one and/or the other of the ends of the sail. As a preference, the device that generates vertical lift has a planar or profiled surface that generates vertical lift. The device that generates vertical lift may comprise at least a part which is mounted with the ability to move about an axis substantially orthogonal to the axis of the sail so as to allow at least part of the device that generates vertical lift to be inclined relative to the sail.

Provision may be made for the system 101 to comprise a tilting mechanism allowing the sail, and possibly its support, to be tilted about a horizontal axis.

The tilting system allows the sail, and possibly its support, to be moved between an upright position in which, when the system is mounted on the deck of the boat, it stands up perpendicular to the deck of the boat, and a tilted position in which, when the system is mounted on the deck of the boat, the sail extends substantially parallel to the deck of the boat.

When the sail is standing vertically and pivots about an axis substantially parallel to the axis of the sail, which is to say, when the sail is in operation—with the sail vertical—and outside of any tilting mobility of the support about an axis horizontal to the axis of the sail, the support remains fixed relative to the deck of the boat. Similarly, the fan is arranged in such a way that when the sail is standing vertically and pivots about an axis substantially parallel to the axis of the sail, the housing of the fan remains fixed relative to the deck of the boat.

The invention is not restricted to the embodiments illustrated in the drawings.

In addition, terms such as "comprising" or "having" do not exclude the inclusion of other elements or steps. Further, features or steps which have been described with reference to one of the embodiments set out hereinabove may also be employed in combination with other features or steps of other embodiments set out hereinabove.

The invention claimed is:

1. A lift-generating system intended to be placed in moving air so as to produce a lift force, the lift-generating system comprising:

a hollow body, referred to as a sail, the sail being elongate along an axis, a peripheral wall of the sail having at least one opening, referred to as suction opening, designed to cause an outside of the sail to communicate with an inside of the sail; and a suction device allowing air to be drawn in through the at least one suction opening; and a support which supports the sail and with respect to which the sail is mounted with ability to pivot about a pivot axis substantially parallel to the axis of the sail, wherein the suction device comprises a fan situated outside the sail and in communication with the inside of the sail so as to draw air through the at least one suction opening in the sail and discharge drawn-in air via an outlet of the fan, the fan comprising an impeller wheel, surrounded by a housing which defines, around the impeller wheel, a duct able to guide the air discharged by the impeller wheel, and a motor to drive a rotation of the impeller wheel about a rotation axis substantially parallel to the axis of the sail, a housing of the fan having an outlet, an axis of the housing outlet being substantially orthogonal to an axis of the impeller wheel of the fan, wherein the lift-generating system comprises a hollow connecting element which extends at least partly between a lower end of the sail and the fan to allow fluidic communication between the sail and the fan.

2. The lift-generating system as claimed in claim 1, wherein the connecting element comprises a form-matching wall having an opening that communicates with the fan.

3. The lift-generating system as claimed in claim 2, wherein the form-matching wall is equipped with an annular element which extends around the opening of the form-matching wall and on a side of the inside of the sail, a cross section of the annular element having a curved profile so as to limit pressure drops experienced by air flowing between the sail and the fan.

4. The lift-generating system as claimed in claim 1, wherein a footprint of the fan is contained within a footprint of the support.

5. The lift-generating system as claimed in claim 1, wherein the fan is a centrifugal fan.

6. The lift-generating system as claimed in claim 1, wherein the fan is a mixed-flow fan.

7. The lift-generating system as claimed in claim 1, wherein the sail is equipped with a device that generates vertical lift, the device that generates vertical lift being mounted close to one and/or another of ends of the sail.

8. The lift-generating system as claimed in claim 7, wherein the device that generates vertical lift comprises at least a part which is mounted with the ability to move about an axis substantially orthogonal to the axis of the sail.

9. The lift-generating system as claimed in claim 7, wherein the device that generates vertical lift comprises a suction system allowing air from outside to be drawn into the inside of the sail.

10. The lift-generating system as claimed in claim 1, wherein the peripheral wall of the sail is equipped with a flap that is able to move relative to the peripheral wall to make it possible to separate a suction-face air flow from a pressure-face air flow.

11. The lift-generating system as claimed in claim 1, wherein the peripheral wall of the sail has two suction openings and a shutoff system, so as to allow one of the suction openings to be selectively shut off and the other of the suction openings to be uncovered.

12. The lift-generating system as claimed in claim 1, wherein the housing of the fan is extended by a variable-section discharge duct.

13. The lift-generating system as claimed in claim 1, wherein the lift-generating system comprises a tilting system to allow the sail to be tilted about an axis substantially orthogonal to the axis of the sail.

14. A boat comprising at least one lift-generating system as claimed in claim 1, wherein the fan is situated between the sail and a deck of the boat, the sail being mounted with the ability to pivot relative to the deck of the boat about an axis substantially parallel to the axis of the sail.

15. The boat as claimed in claim 14, wherein the support is arranged so that, when the sail is standing vertically and pivots about an axis substantially parallel to the axis of the sail, the support remains in a fixed position relative to the deck of the boat.

16. The boat as claimed in claim 14, wherein the fan is arranged so that, when the sail is standing vertically and pivots about an axis substantially parallel to the axis of the sail, the housing of the fan remains in a fixed position relative to the deck of the boat.

17. The boat as claimed in claim 14, wherein the axis of the outlet of the casing of the fan is directed toward a stern of the boat.

18. The lift-generating system as claimed in claim 3, wherein the annular element has a convex profile.

19. The lift-generating system as claimed in claim 11, wherein shutoff system comprises a flap.

20. A lift-generating system intended to be placed in moving air so as to produce a lift force, the lift-generating system comprising:

a hollow body, referred to as a sail, the sail being elongate along an axis, a peripheral wall of the sail having at least one opening, referred to as suction opening, designed to cause an outside of the sail to communicate with an inside of the sail; and a suction device allowing air to be drawn in through the at least one suction opening; and a support which supports the sail and with respect to which the sail is mounted with ability to pivot about a pivot axis substantially parallel to the axis of the sail, wherein the suction device comprises a fan situated outside the sail and in communication with the inside of the sail so as to draw air through the at least one suction opening in the sail and discharge drawn-in air via an outlet of the fan, the fan comprising an impeller wheel, surrounded by a housing which defines, around the impeller wheel, a duct able to guide the air discharged by the impeller wheel, and a motor to drive a rotation of the impeller wheel about a rotation axis substantially parallel to the axis of the sail, a housing of the fan having an outlet, an axis of the housing outlet being substantially orthogonal to an axis of the impeller wheel of the fan, wherein the housing of the fan is extended by a variable-section discharge duct.

21. A lift-generating system intended to be placed in moving air so as to produce a lift force, the lift-generating system comprising:

a hollow body, referred to as a sail, the sail being elongate along an axis, a peripheral wall of the sail having at least one opening, referred to as suction opening, designed to cause an outside of the sail to communicate with an inside of the sail; and a suction device allowing air to be drawn in through the at least one suction opening; and a support which supports the sail and with respect to which the sail is mounted with ability to pivot about a pivot axis substantially parallel to the axis of the sail, wherein the suction device comprises a fan situated outside the sail and in communication with the inside of the sail so as to draw air through the at least one suction opening in the sail and discharge drawn-in air via an outlet of the fan, the fan comprising an impeller wheel, surrounded by a housing which defines, around the impeller wheel, a duct able to guide the air discharged by the impeller wheel, and a motor to drive a rotation of the impeller wheel about a rotation axis substantially parallel to the axis of the sail, a housing of the fan having an outlet, an axis of the housing outlet being substantially orthogonal to an axis of the impeller wheel of the fan, wherein the lift-generating system comprises a tilting system to allow the sail to be tilted about an axis substantially orthogonal to the axis of the sail.

* * * * *